US011194281B2

(12) United States Patent
Haruta

(10) Patent No.: US 11,194,281 B2
(45) Date of Patent: Dec. 7, 2021

(54) IMAGE-FORMING APPARATUS INCLUDING MECHANISM FOR MOVING DEVELOPING ROLLER TOWARD AND AWAY FROM PHOTOSENSITIVE DRUM IN ACCORDANCE WITH ROTATION OF CAM GEAR

(71) Applicant: BROTHER KOGYO KABUSHIKI KAISHA, Nagoya (JP)

(72) Inventor: Kotaro Haruta, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/080,912

(22) Filed: Oct. 27, 2020

(65) Prior Publication Data

US 2021/0157262 A1 May 27, 2021

(30) Foreign Application Priority Data

Nov. 25, 2019 (JP) ..... JP2019-212085

(51) Int. Cl.
*G03G 15/00* (2006.01)
*G03G 21/16* (2006.01)
*G03G 15/16* (2006.01)

(52) U.S. Cl.
CPC ..... *G03G 15/757* (2013.01); *G03G 15/1615* (2013.01); *G03G 21/1647* (2013.01);
(Continued)

(58) Field of Classification Search
CPC ..... G03G 15/1615; G03G 15/757; G03G 21/1647; G03G 2215/2048;
(Continued)

(56) References Cited

U.S. PATENT DOCUMENTS 10,054,900 B2 * 8/2018 Kusama ..... G03G 21/1647
2006/0104666 A1 * 5/2006 Yoon ..... G03G 15/757 399/228

(Continued)

FOREIGN PATENT DOCUMENTS

JP 2009-180918 A 8/2009
JP 2012-128017 A 7/2012

(Continued)

*Primary Examiner* — Francis C Gray
(74) *Attorney, Agent, or Firm* — Merchant & Gould P.C.

(57) ABSTRACT

An image-forming apparatus includes a motor, a photosensitive drum, a developing roller, and a separation mechanism for moving the developing roller relative to the photosensitive drum. The separation mechanism includes: an end cam rotatable in a rotational direction; and a cam follower movable in accordance with a rotation of the end cam. The end cam includes a first surface, a second surface, a first sloped surface connecting the second surface to the first surface, and a second sloped surface connecting the first surface to the second surface in the rotational direction. The second sloped surface includes: a steep slope surface connected to the second surface; and a gentle slope surface connecting the first surface to the steep slope surface. The gentle slope surface slopes relative to the first surface by an angle smaller than an angle by which the steep slope surface slopes relative to the first surface.

14 Claims, 13 Drawing Sheets

(52) U.S. Cl.
CPC ..... *G03G 2215/2048* (2013.01); *G03G 2215/2058* (2013.01)

(58) Field of Classification Search
CPC ..... G03G 2215/2058; G03G 21/1857; G03G 15/087; G03G 15/0808; G03G 15/1675; G03G 15/2053; G03G 15/0126; G03G 15/0189
See application file for complete search history.

(56) References Cited

U.S. PATENT DOCUMENTS

| | | | | |
|---|---|---|---|---|
| 2009/0190958 | A1 | 7/2009 | Wang et al. | |
| 2014/0169833 | A1* | 6/2014 | Kawamura ..... | G03G 21/1825 399/222 |
| 2015/0093145 | A1 | 4/2015 | Tomatsu et al. | |
| 2017/0163827 | A1 | 6/2017 | Higuchi et al. | |
| 2017/0261918 | A1* | 9/2017 | Zensai ..... | G03G 21/1825 |
| 2020/0004198 | A1* | 1/2020 | Nakano ..... | G03G 21/1814 |
| 2020/0409290 | A1* | 12/2020 | Saeki ..... | G03G 15/0896 |

FOREIGN PATENT DOCUMENTS

| | | | |
|---|---|---|---|
| JP | 2015-069095 | A | 4/2015 |
| JP | 2016-014817 | A | 1/2016 |
| JP | 2017-107016 | A | 6/2017 |

* cited by examiner

IMAGE-FORMING APPARATUS INCLUDING MECHANISM FOR MOVING DEVELOPING ROLLER TOWARD AND AWAY FROM PHOTOSENSITIVE DRUM IN ACCORDANCE WITH ROTATION OF CAM GEAR

CROSS REFERENCE TO RELATED APPLICATION

This application claims priority from Japanese Patent Application No. 2019-212085 filed Nov. 25, 2019. The entire content of the priority application is incorporated herein by reference.

TECHNICAL FIELD

The present disclosure relates to an image-forming apparatus capable of moving a developing roller toward and away from a photosensitive drum.

BACKGROUND

There has been known an image-forming apparatus capable of permitting a developing roller to be in pressure contact with and to be separated from a photosensitive drum at a proper timing in order to suppress dissipation of the developing roller (see Japanese Patent Application Publication No. 2015-069095, for example).

SUMMARY

In order to realize contact/separation of the developing roller relative to the photosensitive drum, a gear train is provided for transmitting driving force of a motor to the developing roller. However, meshing engagement between neighboring gears may be reversed due to backlash, and an idle rotation of the gear may occur by an amount of the backlash, resulting in generation of a collision sound when the developing roller is moved from a separated position toward a contact position.

In view of the foregoing, it is an object of the disclosure to provide an image-forming apparatus capable of restraining generation of collision sound when a developing roller is moved from its separated position toward its contact position.

In order to attain the above and other objects, according to one aspect, the disclosure provides an image-forming apparatus including a motor, a photosensitive drum, a developing roller, and a separation mechanism. The developing roller is movable between a contact position where the developing roller is in contact with the photosensitive drum and a separated position where the developing roller is separated from the photosensitive drum. The separation mechanism is configured to move the developing roller between the contact position and the separated position upon receipt of a driving force from the motor. The separation mechanism includes: an end cam rotatable in a rotational direction; and a cam follower movable between a first position at which the developing roller is at the separated position and a second position at which the developing roller is at the contact position in accordance with a rotation of the end cam. The end cam includes: a first surface; a second surface; a first sloped surface connecting the second surface to the first surface in the rotational direction; and a second sloped surface connecting the first surface to the second surface in the rotational direction. The gentle slope surface is sloped relative to the first surface by a second angle smaller than the first angle. The first surface is configured to support the cam follower at the first position. The second surface is configured to support the cam follower at the second position. The first sloped surface is configured to guide the cam follower from the second surface to the first surface. The second sloped surface is configured to guide the cam follower from the first surface to the second surface. The second sloped surface includes: a steep slope surface connected to the second surface in the rotational direction and sloping relative to the first surface by a first angle; and a gentle slope surface connecting the first surface to the steep slope surface in the rotational direction.

According to another aspect, the disclosure also provides an image-forming apparatus including a motor, a photosensitive drum, a developing roller, and a separation mechanism. The developing roller is movable between a contact position where the developing roller is in contact with the photosensitive drum and a separated position where the developing roller is separated from the photosensitive drum. The separation mechanism is configured to move the developing roller between the contact position and the separated position upon receipt of a driving force from the motor. The separation mechanism includes: an end cam rotatable in a rotational direction about a rotation axis extending in an axial direction; and a cam follower movable in the axial direction between a first position at which the developing roller is at the separated position and a second position at which the developing roller is at the contact position in accordance with a rotation of the end cam. The end cam includes: a first surface; a second surface; a first sloped surface connecting the second surface to the first surface in the rotational direction; and a second sloped surface connecting the first surface to the second surface in the rotational direction. The second sloped surface is being connected to the first surface at a joint portion in the rotational direction. The second sloped surface has: a predetermined angular region starting from the joint portion in the rotational direction; and an outside angular region outside of the predetermined angular region in the rotational direction. The first surface is configured to support the cam follower at the first position. The second surface is configured to support the cam follower at the second position. The first sloped surface is configured to guide the cam follower from the second surface to the first surface. The second sloped surface is configured to guide the cam follower from the first surface to the second surface. An amount of displacement of the cam follower in the axial direction per unit rotation angle of the end cam while the cam follower is in contact with the predetermined angular region is smaller than an amount of displacement of the cam follower in the axial direction per unit rotation angle of the end cam while the cam follower is in contact with the outside angular region.

BRIEF DESCRIPTION OF THE DRAWINGS

The particular features and advantages of the embodiment(s) as well as other objects will become apparent from the following description taken in connection with the accompanying drawings, in which:

FIG. 12B particularly illustrates a state where the cam follower is in contact with a first sloped surface of the end cam;

FIG. 12C particularly illustrates a state where the cam follower is in contact with a first surface of the end cam;

FIG. 12D particularly illustrates a state where the cam follower is in contact with a gentle slope surface of the end cam;

FIG. 12E particularly illustrates a state where the cam follower is in contact with a steep slope surface of the end cam;

DETAILED DESCRIPTION

Figure 1:
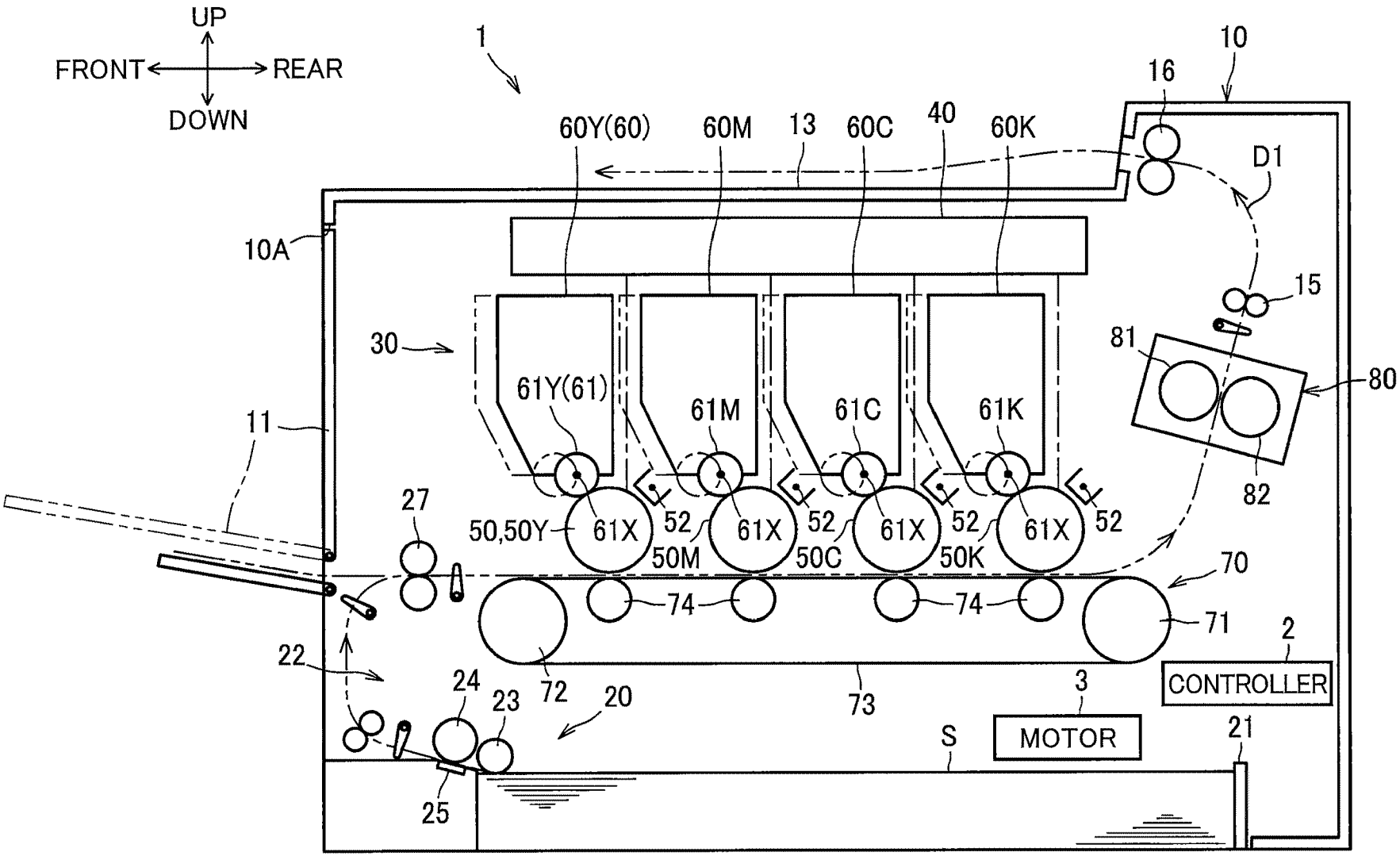
FIG. 1 is a schematic view of an image-forming apparatus according to one embodiment.

Hereinafter, an image-forming apparatus 1 according to one embodiment of the present disclosure will be described with reference to FIGS. 1 through 12E.

<General Configuration>

The image-forming apparatus 1 according to the present embodiment is a color printer. The image-forming apparatus 1 includes a housing 10, a cover 11, a sheet supplying unit 20, an image forming unit 30, a controller 2, and a motor 3.

Incidentally, throughout the specification, a left side, a right side, an upper side, and a lower side in FIG. 1 will be referred to as a front side, a rear side, an upper side, and a lower side of the image-forming apparatus 1, respectively. Further, a near side and a far side in FIG. 1 will be referred to as a right side and a left side of the image-forming apparatus 1, respectively.

The housing 10 has a front end formed with a first opening 10A. The cover 11 is pivotally movable between a closed position closing the first opening 10A (indicated by solid lines in FIG. 1) and an open position opening the first opening 10A (indicated by two-dotted chain lines in FIG. 1). The housing 10 is provided with a cover sensor (not illustrated) configured to detect an opening/closing state of the cover 11, and the controller 2 is configured to determine the opening/closing state of the cover 11 in response to a signal transmitted from the cover sensor.

The sheet supplying unit 20 is positioned at a lower internal portion of the housing 10. The sheet supplying unit 20 includes: a sheet tray 21 on which sheets S are accommodated; and a sheet supply mechanism 22 configured to supply each of the sheets S from the sheet tray 21 toward the image forming unit 30. The sheet tray 21 is detachable from the housing 10 by pulling the sheet tray 21 out of the housing 10 frontward, i.e., in a direction toward the left in FIG. 1.

The sheet supply mechanism 22 is positioned at a front internal portion of the housing 10. The sheet supply mechanism 22 includes a sheet supply roller 23, a separation roller 24, a separation pad 25, and a pair of registration rollers 27. The sheets S of the embodiment are an image-recording medium on which the image-forming apparatus 1 can form an image. For example, plain sheets of paper, envelopes, cards, thin sheets of paper, thick sheets of paper, calendered paper, resin sheets, and seals may be available as the sheets S.

In the sheet supplying unit 20, the sheets S accommodated in the sheet tray 21 is fed by the sheet supply roller 23, and then separated one by one by the separation roller 24 and the separation pad 25. Thereafter, a position of a leading edge of the sheet S is regulated by the registration rollers 27 while rotations of the registration rollers 27 are halted, and the sheet S is then conveyed to the image forming unit 30 by the rotations of the registration rollers 27.

The image forming unit 30 includes an exposure device 40, a drawer 90 (FIG. 2) provided with a plurality of photosensitive drums 50, a plurality of developing cartridges 60, a conveying device 70, and a fixing device 80.

The exposure device 40 includes a laser diode, a deflector, lenses, and mirrors those not illustrated. The exposure device 40 is configured to emit a plurality of laser beams toward the plurality of photosensitive drums 50 to expose peripheral surfaces of the respective photosensitive drums 50 to the laser beams, thereby scanning the peripheral surfaces of the photosensitive drums 50.

The drawer 90 is attachable to and detachable from the housing 10 through the first opening 10A while the cover 11 is opened relative to the housing 10. The drawer 90 rotatably supports the plurality of photosensitive drums 50 (see FIG. 2). The plurality of photosensitive drums 50 includes: a first photosensitive drum 50Y for a color of yellow; a second photosensitive drum 50M for a color of magenta; a third photosensitive drum 50C for a color of cyan; and a fourth photosensitive drum 50K for a color of black. The first photosensitive drum 50Y, the second photosensitive drum 50M, the third photosensitive drum 50C, and the fourth photosensitive drum 50K are arrayed in this order from the front toward the rear. The direction of the array of the photosensitive drums 50 will be referred to as an array direction hereinafter, whenever appropriate. Details of the drawer 90 will be descried later.

Throughout the specification and drawings, in a case where colors must be specified, members or components corresponding to the colors of yellow, magenta, cyan and black are designated by reference numerals followed by "Y", "M", "C", "K", respectively. On the other hand, in a case where distinction of colors is unnecessary, the addition of "Y", "M", "C", "K" is omitted and the naming of "first" through "fourth" is also omitted.

The developing cartridges 60 are provided for the respective photosensitive drums 50. Specifically, the plurality of developing cartridges 60 includes: a first developing cartridge 60Y including a first developing roller 61Y for supplying toner (yellow) to the first photosensitive drum 50Y; a second developing cartridge 60M including a second developing roller 61M for supplying toner (magenta) to the second photosensitive drum 50M; a third developing cartridge 60C including a third developing roller 61C for supplying toner (cyan) to the third photosensitive drum 50C; and a fourth developing cartridge 60K including a fourth developing roller 61K for supplying toner (black) to the fourth photosensitive drum 50K.

The developing cartridges 60 (the first developing cartridge 60Y, the second developing cartridge 60M, the third developing cartridge 60C, and the fourth developing cartridge 60K) are detachable from and attachable to the drawer 90. When attached to the drawer 90, the first developing roller 61Y, the second developing roller 61M, the third developing roller 61C, and the fourth developing roller 61K are arrayed in this order from the front toward the rear, i.e., toward downstream in the sheet conveying direction D1 (indicated by a phantom line in FIG. 1).

Each developing cartridge 60 is movable between a contact position where the developing roller 61 is in contact with the corresponding photosensitive drum 50 (indicated by a solid line in FIG. 1) and a separated position where the developing roller 61 is separated from the corresponding photosensitive drum 50 (indicated by a two-dotted chain line in FIG. 1).

The conveying device 70 is positioned between the sheet tray 21 and the photosensitive drums 50 while the drawer 90 is positioned inside the housing 10. The conveying device 70 includes a drive roller 71, a follower roller 72, an endless belt as a conveyer belt 73, and four transfer rollers 74. The conveyer belt 73 is looped over the drive roller 71 and the follower roller 72 under tension. The conveyer belt 73 has an outer peripheral surface (upper peripheral surface) facing each of the photosensitive drums 50. Each transfer roller 74 is positioned within a loop of the conveyer belt 73 to nip the conveyer belt 73 in cooperation with each photosensitive drum 50. The sheet S is conveyed rearward as the conveyer belt 73 circulates while the sheet S is mounted on the upper outer peripheral surface of the conveyer belt 73. While the sheet S is conveyed by the conveyer belt 73, each toner image formed on each photosensitive drum 50 is sequentially transferred onto the sheet S.

The fixing device 80 is positioned rearward of the photosensitive drum 50K and the conveying device 70 within the housing 10. The fixing device 80 includes a heat roller 81 and a pressure roller 82 positioned in confrontation with the heat roller 81. A pair of conveyer rollers 15 is positioned above the fixing device 80, and a pair of discharge rollers 16 is further positioned above the conveyer rollers 15.

In the image forming unit 30, the peripheral surface of each photosensitive drum 50 is uniformly charged by a corresponding charger 52 provided at the drawer 90, and is then exposed to light (the laser beam) irradiated from the exposure device 40. In this way, an electrostatic latent image on a basis of image data is formed on the peripheral surface of each photosensitive drum 50.

In the meantime, toner accommodated in a casing 63 of each developing cartridge 60 is carried on a peripheral surface of each developing roller 61. The toner is then supplied from each developing roller 61 to the electrostatic latent image on the peripheral surface of the corresponding photosensitive drum 50 while the developing roller 61 is in contact with the corresponding photosensitive drum 50. Hence, a toner image is formed on the peripheral surface of each photosensitive drum 50.

The toner image on each photosensitive drum 50 is sequentially transferred onto the sheet S as the sheet S mounted on the conveyer belt 73 moves past a position between each photosensitive drum 50 and each transfer roller 74. Thereafter, the toner image transferred onto the sheet S is thermally fixed to the sheet S while the sheet S moves past a position between the heat roller 81 and the pressure roller 82.

The sheet S discharged from the fixing device 80 is finally discharged out of the housing 10 by the conveyer rollers 15 and the discharge rollers 16 and accumulated onto a discharge tray 13 formed on a top surface of the housing 10.

<Drawer 90>

Figure 2:
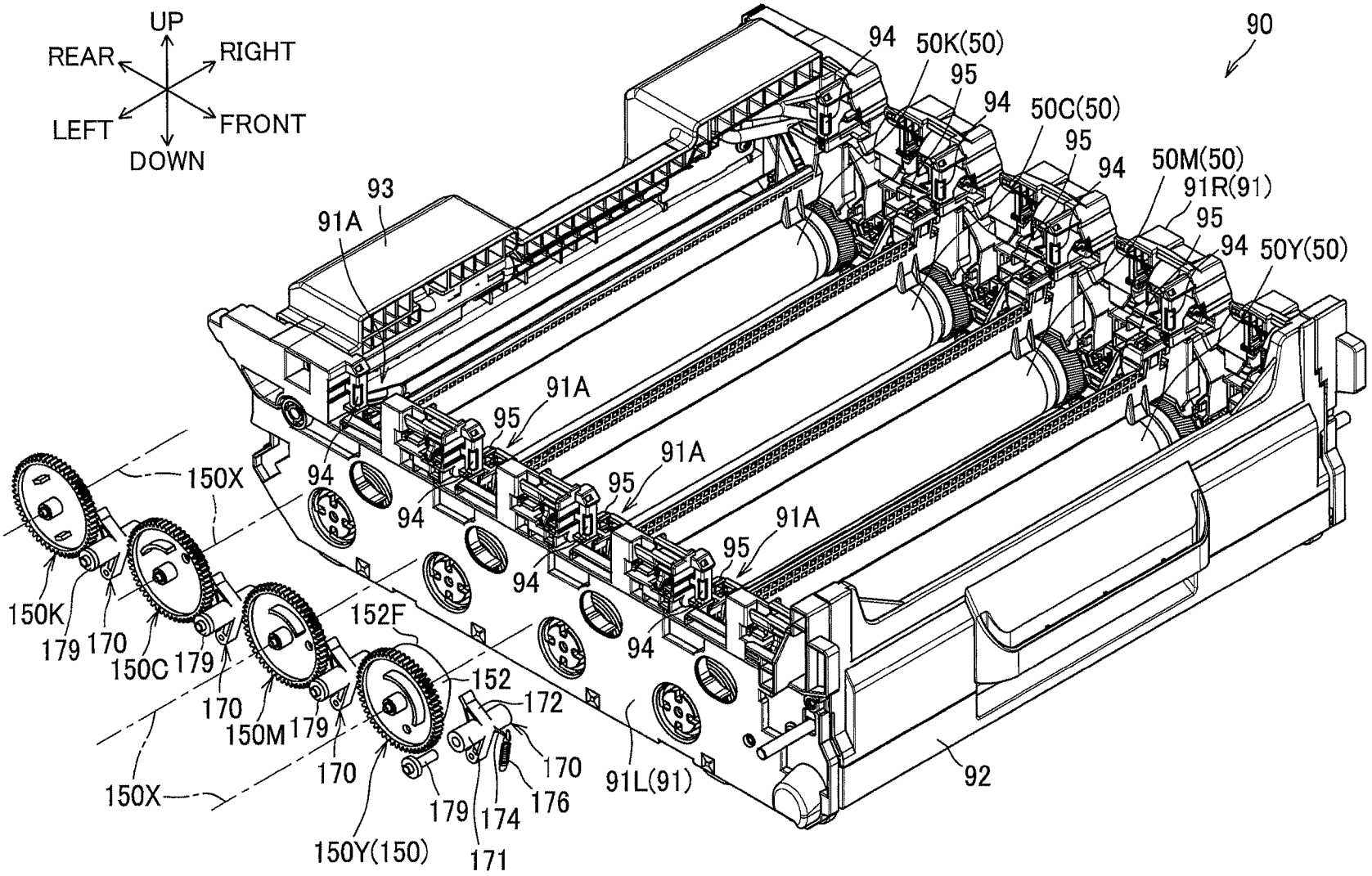
FIG. 2 is a perspective view of a drawer, cam gears, and cam followers in the image-forming apparatus according to the embodiment.

As illustrated in FIG. 2, the drawer 90 rotatably supports the photosensitive drums 50. The drawer 90 includes: a pair of side frames 91 positioned away from each other in an axial direction of the photosensitive drum 50 (a leftward/rightward direction); a front connection frame 92 connecting together front end portions of the respective side frames 91; and a rear connection frame 93 connecting together rear end portions of the side frames 91. The pair of side frames 91 includes a right side frame 91R and a left side frame 91L. Four of the chargers 52 (FIG. 1) are provided in the drawer 90 one each for each of the photosensitive drums 50. Each charger 52 is positioned to face the corresponding photosensitive drum 50 for charging the same.

The side frames 91 respectively support left and right end portions of each photosensitive drum 50 (i.e., end portions of each photosensitive drum 50 in the axial direction). Further, one of the side frames 91 (the left side frame 91L in the embodiment) is formed with four second openings 91A. Each second opening 91A is in a form of a notch or a recess that is recessed downward from an upper periphery of the left side frame 91L. Each second opening 91A extends throughout a thickness of the left side frame 91L in the leftward/rightward direction. Each second opening 91A is configured to allow a corresponding cam follower 170 (described later) to be received therein.

Each of the left side frame 91L and the right side frame 91R also includes four pairs of counterpart abutment portions 94. The counterpart abutment portions 94 are provided on respective upper portions of the right and left side frames 91R and 91L. The counterpart abutment portions 94 in each pair are arranged to oppose each other in the leftward/rightward direction and are configured to abut against a slide member 64 (described later) of the corresponding developing cartridge 60 (see FIG. 4). Each counterpart abutment portion 94 is in a form of a roller rotatable about an axis extending in an upward/downward direction which is perpendicular to the axial direction of the photosensitive drum 50 (leftward/rightward direction) and the array direction of the photosensitive drums 50 (frontward/rearward direction).

Referring to FIGS. 2 and 4, the drawer 90 is further provided with a plurality of (four pairs of) pressure members 95 one pair for each of the developing cartridges 60. The pressure members 95 in each pair are positioned outward of the corresponding photosensitive drum 50 in the axial direction for each developing cartridge 60. Each pressure member 95 is urged rearward by a corresponding spring 95A. Upon attachment of the developing cartridges 60 to the drawer 90, each pressure member 95 presses a protrusion 63D (described later) of the corresponding developing cartridge 60 by an urging force of the spring 95A, so that the developing roller 61 of the developing cartridge 60 is in pressure contact with the corresponding photosensitive drum 50.

<Developing Cartridge 60>

Figure 3A:
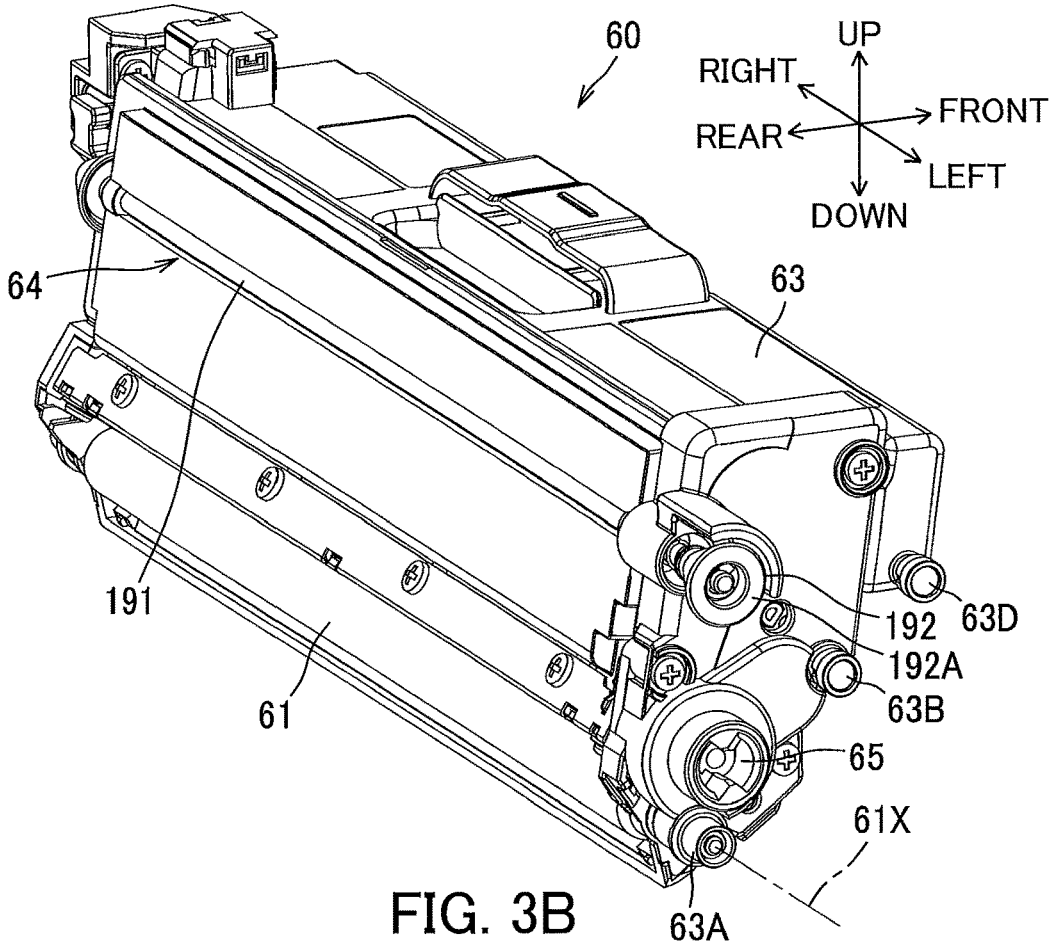
FIG. 3A is a perspective view of a developing cartridge in the image-forming apparatus according to the embodiment.
Figure 3B:
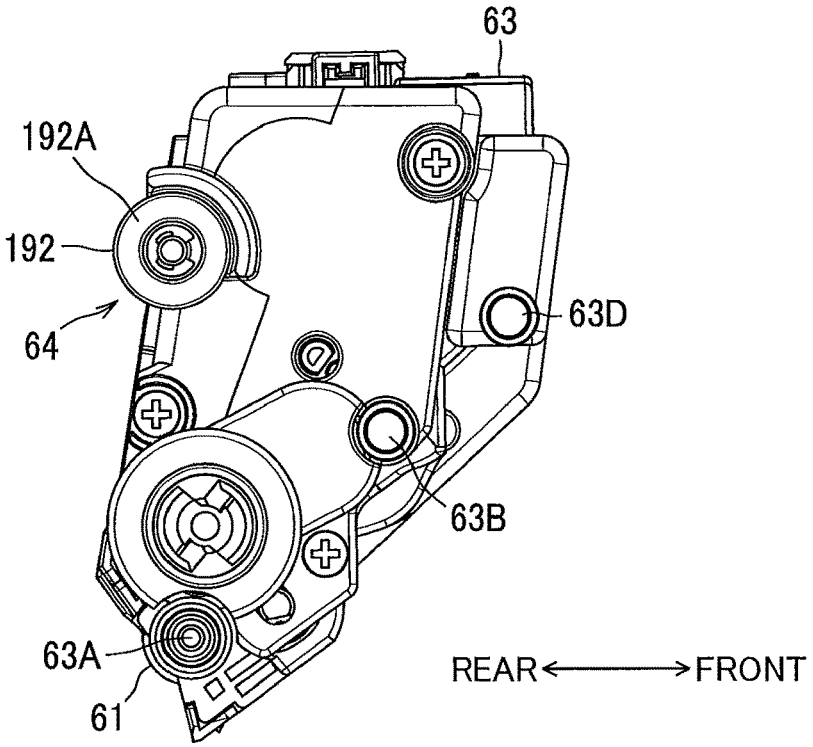
FIG. 3B is a side view of the developing cartridge of FIG. 3A.

As illustrated in FIGS. 3A and 3B, each developing cartridge 60 (60Y, 60M, 60C, 60K) includes the casing 63, the slide member 64, and a coupling 65.

The casing 63 stores toner therein. The casing 63 has one side surface in the axial direction (i.e., a left side surface) provided with a first protruding portion 63A and a second protruding portion 63B. The first and second protruding portions 63A and 63B protrude outward in the axial direction (leftward) from the one side surface in the axial direction (left side surface). The first protruding portion 63A is coaxial with a rotation axis 61X of the developing roller 61, which is parallel to the axial direction of the photosensitive drum 50.

The second protruding portion 63B is positioned away from the first protruding portion 63A by a predetermined distance. In the present embodiment, the second protruding portion 63B is positioned above the first protruding portion 63A. The first and second protruding portions 63A and 63B are rollers rotatable about their axes each extending in parallel to the axial direction of the photosensitive drum 50. Although not illustrated, the first and second protruding portions 63A and 63B are also provided at another side surface of the casing 63 in the axial direction (i.e., at a right side surface) at positions symmetrical with the first and second protruding portions 63A and 63B provided at the one side surface (left side surface).

Further, the above-described protrusion 63D is provided on each axial end surface of the casing 63 to protrude therefrom outward in the axial direction. Each protrusion 63D is positioned frontward of the first and second protruding portions 63A and 63B on the corresponding side surface of the casing 63 in the axial direction.

The coupling 65 is configured to be engaged with a corresponding coupling shaft 119 (see FIGS. 7 and 8) provided at the housing 10. Rotational driving force is configured to be inputted to the coupling 65 from the corresponding coupling shaft 119.

Figure 5:
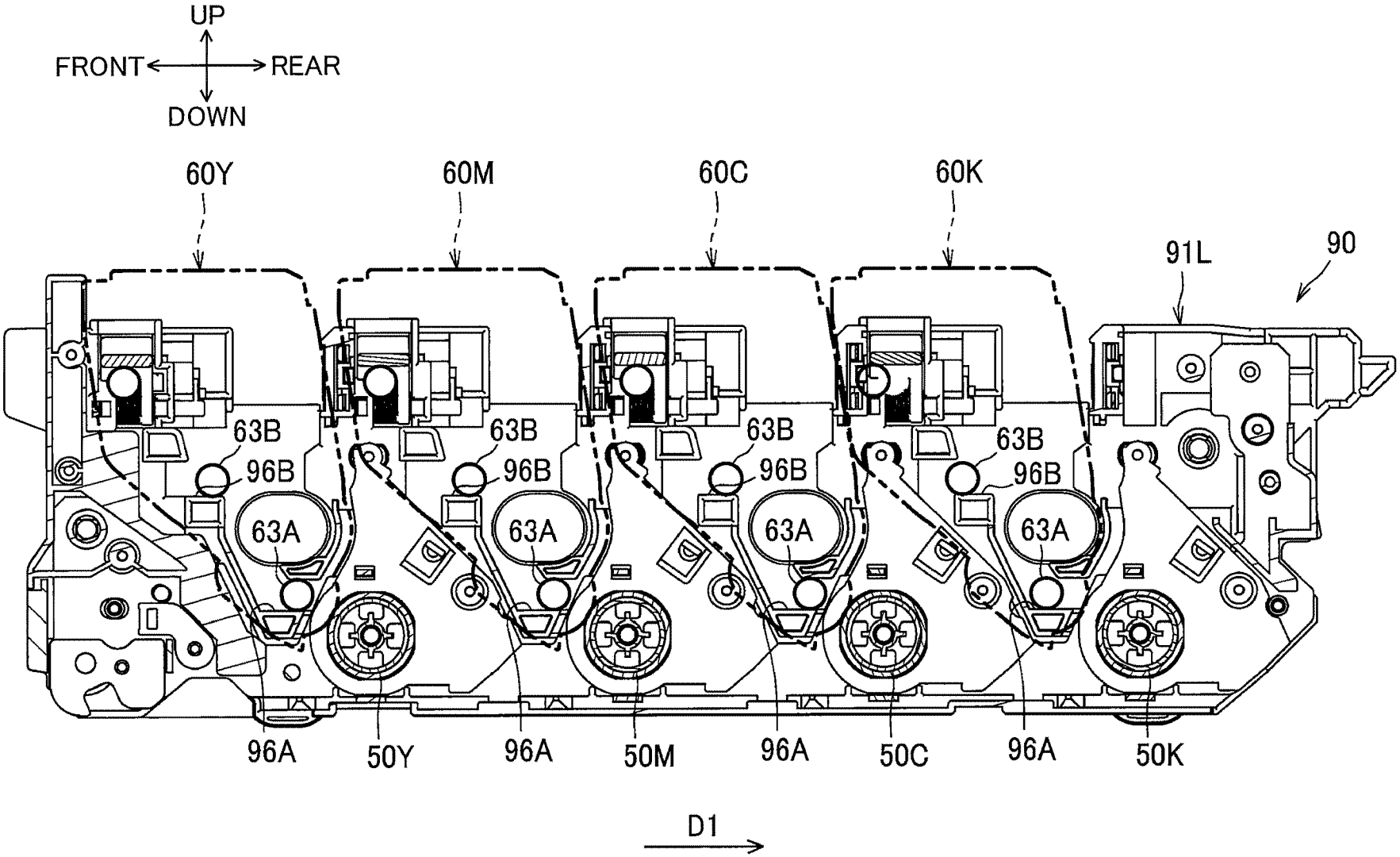
FIG. 5 is a side view of a side frame of the drawer, and particularly illustrating an inner surface of the side frame to which the developing cartridges are attachable.

As illustrated in FIG. 5, the side frame 91L of the drawer 90 has an inner surface provided with four pairs of a first support surface 96A and a second support surface 96B. The first support surface 96A and the second support surface 96B in each pair are configured to respectively support the first protruding portion 63A and the second protruding portion 63B of the corresponding developing cartridge 60 from below when the developing cartridge 60 (the developing roller 61) is moved from the contact position to the separated position. The first support surface 96A and the second support surface 96B extend in the sheet conveying direction D1.

More specifically, the first support surface 96A is positioned to support the first protruding portion 63A. The first support surface 96A is configured to guide the developing roller 61 and to fix a position in the upward/downward direction of the developing roller 61 when the corresponding developing cartridge 60 is attached to the drawer 90. The second support surface 96B is positioned above the first support surface 96A in the same pair to support the second protruding portion 63B. Although not illustrated, the first and second support surfaces 96A and 96B are also provided at an inner surface of the right side frame 91R of the drawer 90 respectively at positions symmetrical with the first and second support surfaces 96A and 96B of the left side frame 91L.

Referring to FIG. 5, when the developing roller 61 is at the contact position in contact with the corresponding photosensitive drum 50, the first protruding portion 63A is positioned on a rear region of the corresponding first support surface 96A (see the first protruding portions 63A of the first through third developing cartridges 60Y, 60M and 60C in FIG. 5). In contrast, when the developing roller 61 is at the separated position away from the corresponding photosensitive drum 50, the first protruding portion 63A is positioned on a front region of the corresponding first support surface 96A (see the first protruding portion 63A of the fourth developing cartridge 60K in FIG. 5).

In this way, the first through fourth developing rollers 61Y, 61M, 61C and 61K are configured to be moved in a direction opposite to the sheet conveying direction D1 (i.e., toward the front) when moving from the respective contact positions to the separated positions by separation mechanisms described next.

<Structures and Mechanisms for Realizing Contact/Separation of the Developing Roller 61 relative to Photosensitive Drum 50>

The image-forming apparatus 1 further includes four separation mechanisms (FIG. 2) configured to move the first developing roller 61Y, the second developing roller 61M, the third developing roller 61C and the fourth developing roller 61K, respectively, between the contact position (where the developing roller 61 is in contact with the corresponding photosensitive drum 50) and the separated position (where the developing roller 61 is separated away from the corresponding photosensitive drum 50). One separation mechanism is provided for each of the four colors of yellow, magenta, cyan and black (first through fourth colors).

Specifically, as illustrated in FIGS. 2 and 4, each separation mechanism includes a support shaft 179, a cam gear 150 (150Y, 150M, 150C, 150K), the cam follower 170, the slide member 64, and a spring 176.

The support shaft 179 is a shaft elongated in the leftward/rightward direction. The support shaft 179 is provided at a side frame (not illustrated) of the housing 10.

Figure 9A:
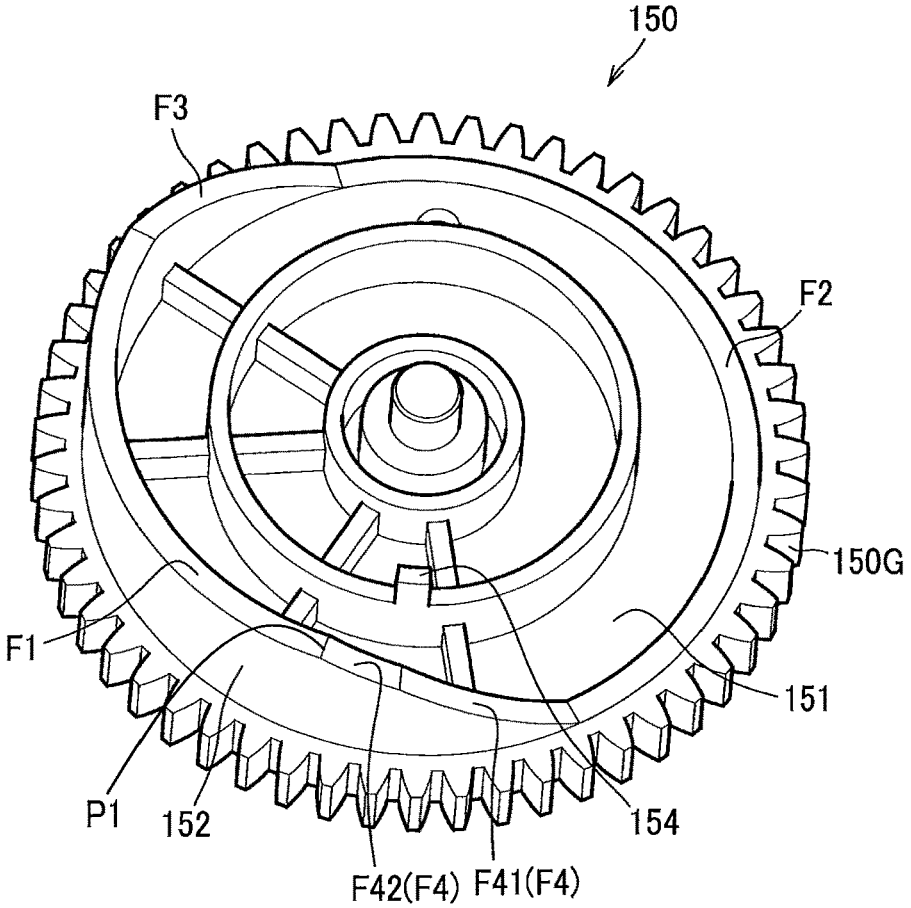
FIG. 9A is a perspective view of the cam gear in the image-forming apparatus according to the embodiment.

The cam gear 150 is rotatable about a rotation axis 150X that extends in parallel to the rotation axis 61X (FIG. 1) of the developing roller 61. That is, the rotation axis 150X is coincident with the axial direction of the photosensitive drum 50. Hence, hereinafter, an extending direction of the rotation axis 150X will be also referred to as the "axial direction." As illustrated in FIG. 9A, the cam gear 150 includes a disc portion 151, a gear portion 150G, an end cam 152, and a counterpart detecting portion 154. The cam gear 150 is made from polyacetal resin.

Figure 7:
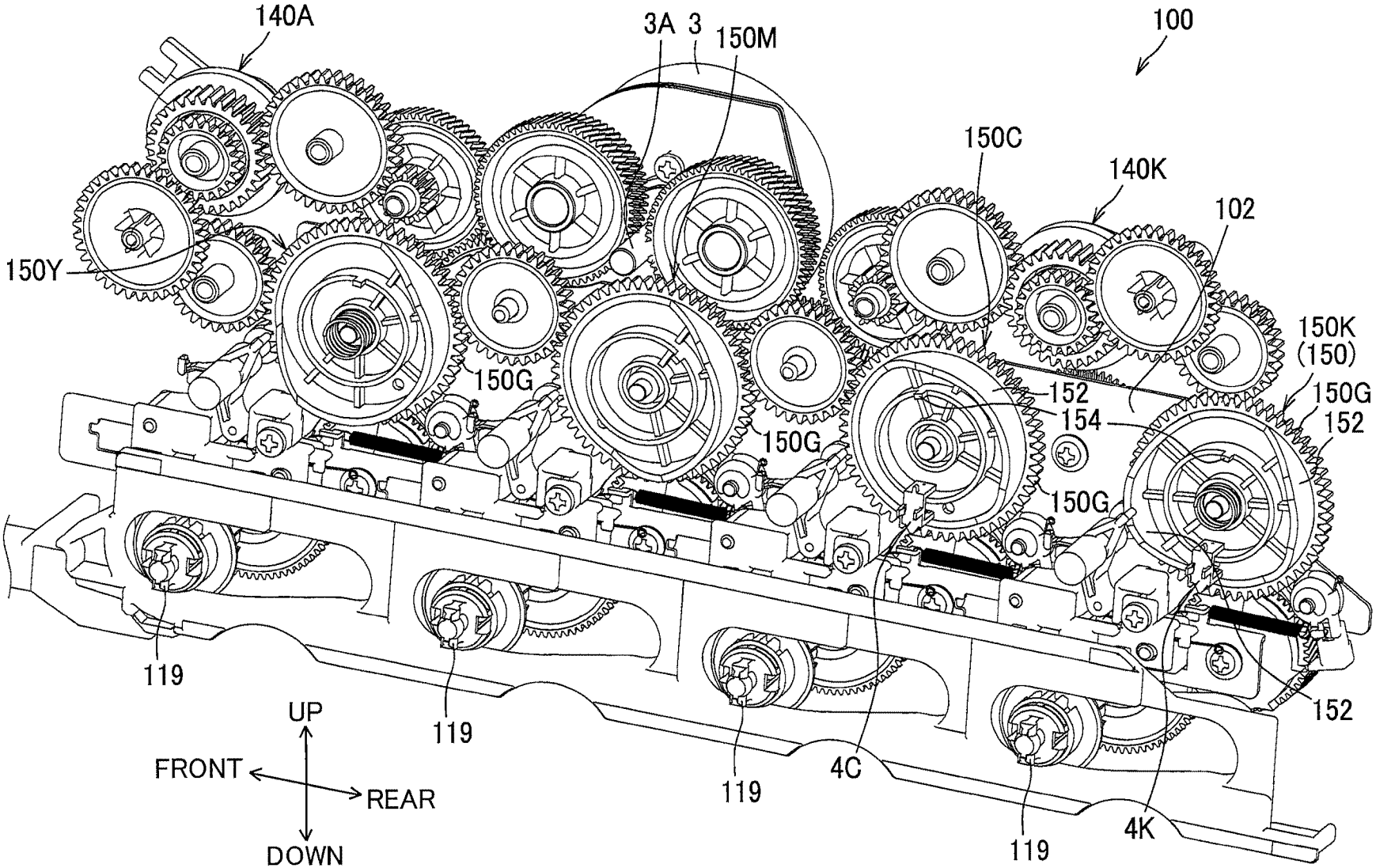
FIG. 7 is a perspective view of the power transmission mechanism as viewed from an upper right side thereof.

The disc portion 151 is generally disc shaped, and is rotatably supported by a support plate 102 (see FIG. 7). The disc portion 151 defines a center thereof that is coincident with a rotation center of the cam gear 150. The rotation axis 150X passes through the center of the disc portion 151 in the axial direction.

The gear portion 150G is provided on an outer peripheral surface of the disc portion 151, i.e., along a circumference of the disc portion 151. The gear portion 150G is configured to receive driving force from the motor 3.

The end cam 152 is provided on the disc portion 151 to protrude from the disc portion 151 rightward, i.e., in the axial direction (in the extending direction of the rotation axis 150X of the cam gear 150). The end cam 152 extends in the rotational direction of the cam gear 150 along a peripheral portion of the disc portion 151. The end cam 152 has a first surface F1, a second surface F2, a first sloped surface F3, and a second sloped surface F4. These surfaces F1-F4 constitute a right end face of the end cam 152 configured to contact the cam follower 170 in the axial direction.

Figure 4A:
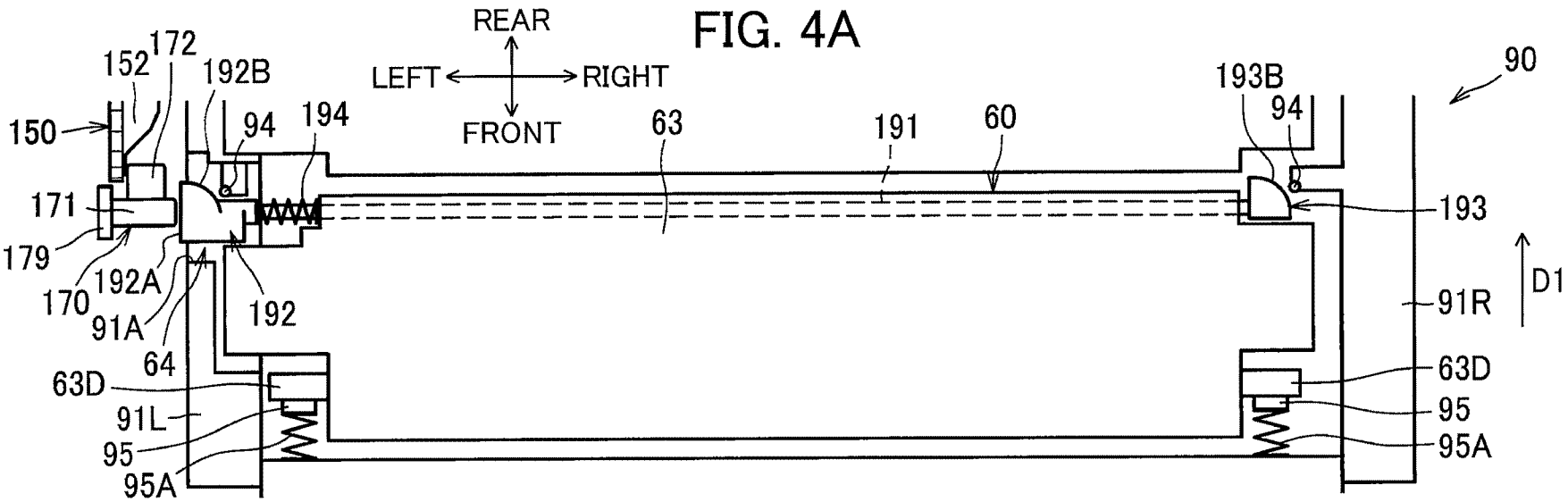
FIG. 4A is a schematic plan view illustrating the developing cartridge and components ambient thereto for description of a slide member of the developing cartridge, and particularly illustrating a state where the cam follower is at a second position.
Figure 4B:
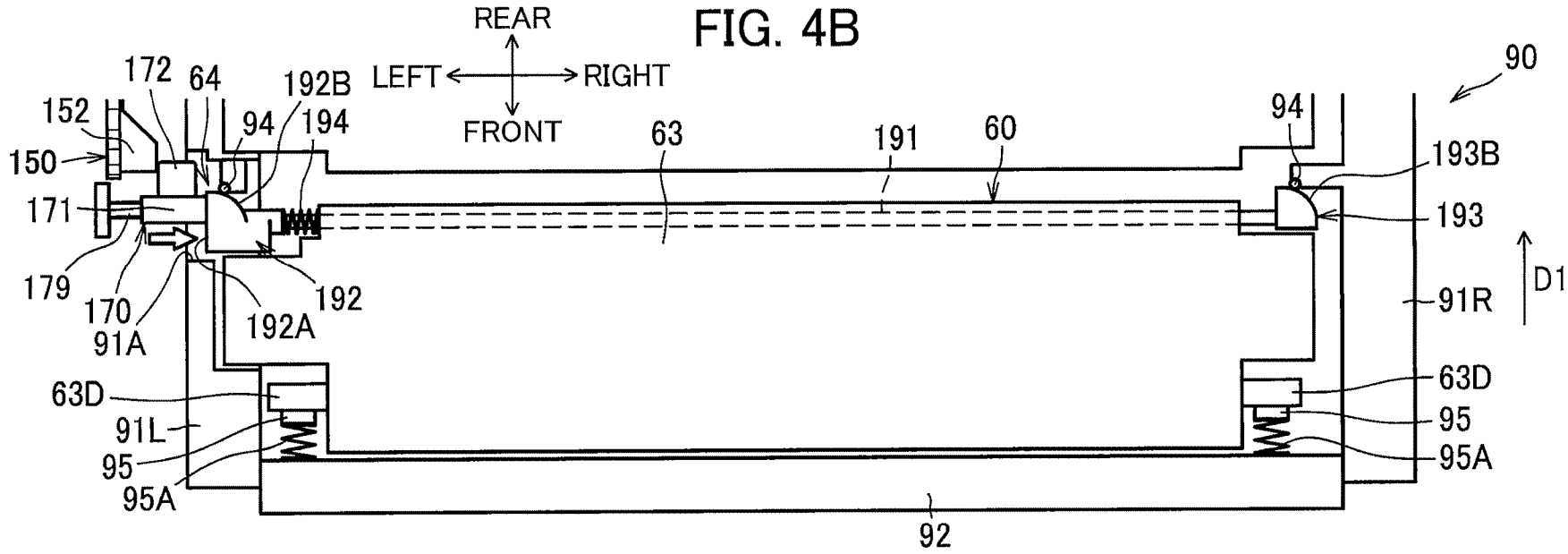
FIG. 4B is a schematic plan view illustrating the developing cartridge and components ambient thereto for description of the slide member of the developing cartridge, and particularly illustrating a state where the cam follower is at a first position.
Figure 10:
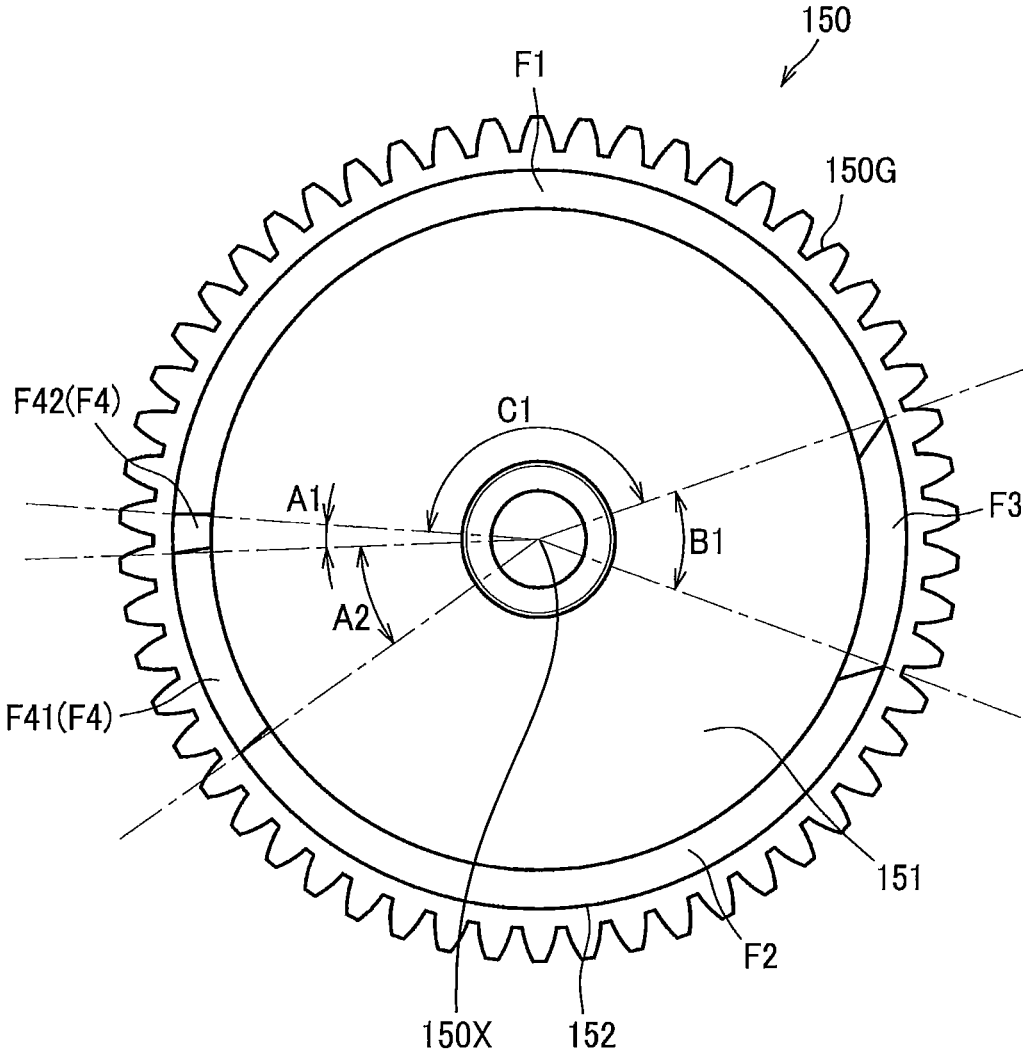
FIG. 10 is a side view of the cam gear as viewed in the axial direction.
Figure 11:
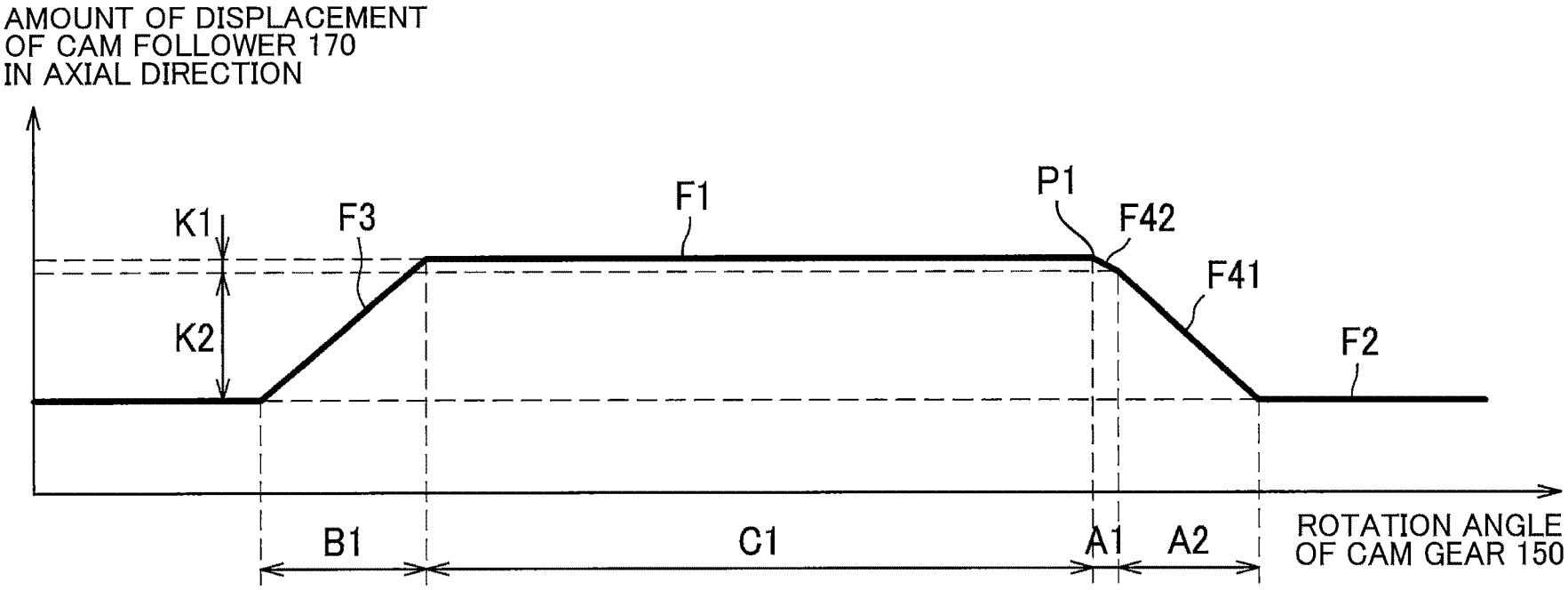
FIG. 11 is a graphical representation illustrating a relationship between a height of an end cam of the cam gear and a rotation angle of the cam gear.

The first surface F1 is positioned away from the disc portion 151 in the axial direction of the cam gear 150, and is configured to support the cam follower 170 to be maintained at a first position thereof (illustrated in FIG. 4B). As illustrated in FIGS. 10 and 11, the first surface F1 extends in a rotational direction of the cam gear 150 to form a central angle of C1 about the rotation center of the cam gear 150.

The second surface F2 is positioned closer to the disc portion 151 than the first surface F1 is to the disc portion 151 in the axial direction. The second surface F2 is configured to permit the cam follower 170 to be positioned at a second position (illustrated in FIG. 4A).

The first sloped surface F3 connects the second surface F2 to the first surface F12. The first sloped surface F3 is sloped with respect to the first surface F1. The first sloped surface F3 is configured to guide the cam follower 170 from the second surface F2 to the first surface F1 in accordance with rotations of the cam gear 150. As illustrated in FIGS. 10 and 11, the first sloped surface F3 extends in the rotational direction of the cam gear 150 to form a central angle of B1 about the rotation center of the cam gear 150.

The second sloped surface F4 connects the first surface F1 to the second surface F2. The second sloped surface F4 is sloped with respect to the first surface F1. The second sloped surface F4 is configured to guide the cam follower 170 from the first surface F1 to the second surface F2 in accordance with the rotations of the cam gear 150. The second sloped surface F4 has a steep slope surface F41 and a gentle slope surface F42.

Figure 9B:
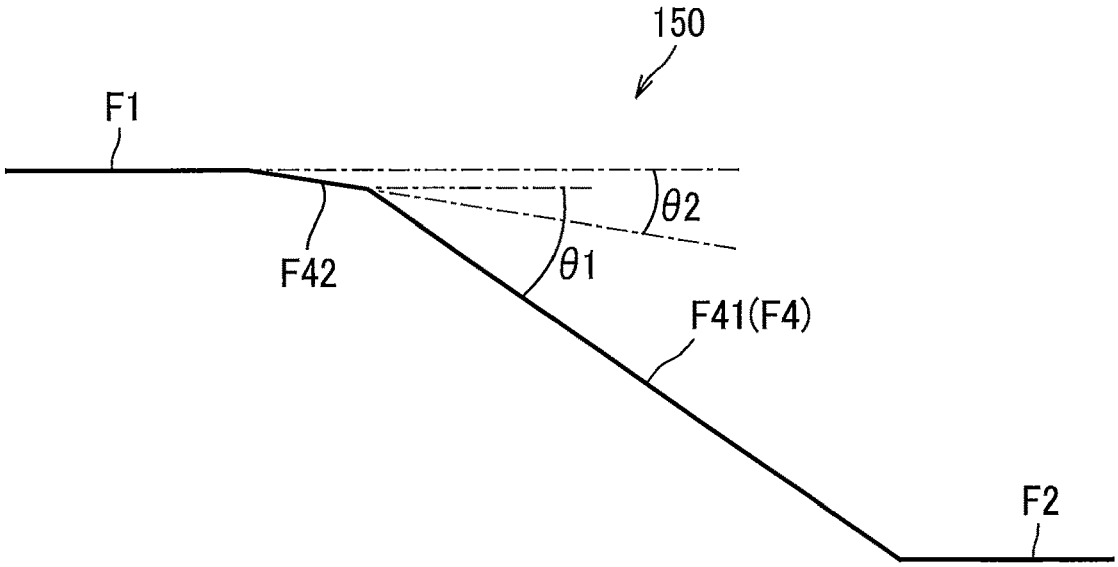
FIG. 9B is a view illustrating surfaces constituting an end cam of the cam gear of the FIG. 9A.

The steep slope surface F41 is sloped with respect to the first surface F1 by an angle θ1 (see FIG. 9B). Preferably, the angle θ1 defined between the steep slope surface F41 and the first surface F1 may be in a range of from 30 to 40 degrees, and more preferably, from 32 to 36 degrees. In the present embodiment, the steep slope surface F41 and the first surface F1 form the angle θ1 of 34 degrees therebetween.

The gentle slope surface F42 connects the steep slope surface F41 to the first surface F1. Referring to FIGS. 9A and 9B, the gentle slope surface F42 is sloped relative to the first surface F1 by an angle θ2 that is smaller than the angle θ1 of slope of the steep slope surface F41 relative to the first surface F1. Preferably, the angle θ2 between the gentle slope surface F42 and the first surface F1 is in a range of from 15 to 25 degrees, and more preferably, from 21 to 25 degrees. In the present embodiment, the angle θ2 between the gentle slope surface F42 and the first surface F1 is 23 degrees.

As illustrated in FIG. 10, the gentle slope surface F42 and the steep slope surface F41 extend in the rotational direction of the cam gear 150 to form central angles of A1, and A2, respectively about the rotation center of the cam gear 150 (coincident with the rotation axis 150X in FIG. 10). The central angle A1 for the gentle slope surface F42 is smaller than the central angle A2 for the steep slope surface F41. Preferably, the central angle A1 defining an extending range of the gentle slope surface F42 in the rotational direction of the cam gear 150 is not more than one-fourth of the central angle A2 defining an extending range of the steep slope surface F41 in the rotational direction of the cam gear 150. In the present embodiment, the central angle A1 for the gentle slope surface F42 is in a range of from one-sixth to one-fifth of the central angle A2 for the steep slope surface F41.

As illustrated in FIG. 11, the gentle slope surface F42 occupies a predetermined angular region (the central angle A1) from a portion at which the first surface F1 is connected to the second sloped surface F4 in the rotational direction of the cam gear 150 (hereinafter, for simplifying description, this portion of connection between the gentle slope surface F42 and the first surface F1 will be referred to as a joint portion P1). In other words, the predetermined angular region is a region starting from the joint portion P1 and extending in the rotational direction of the cam gear 150. On the other hand, the steep slope surface F41 is positioned outside of the predetermined angular region (outside of the central angle A1) from the joint portion P1 in the rotational direction of the cam gear 150. In other words, this region outside of the predetermined angular region is a region connected to the predetermined angular region and to the second surface F2 in the rotational direction of the cam gear 150.

While the cam follower 170 is in contact with the predetermined angular region of the second sloped surface F4 (i.e. on the gentle slope surface F42), the cam follower 170 is displaced in the axial direction by an amount K1. While the cam follower 170 is in contact with an angular region outside the predetermined angular region of the second sloped surface F4 (i.e., on the steep slope surface F41), the cam follower 170 is displaced in the axial direction by an amount K2. In the present embodiment, the amount of displacement K1 of the cam follower 170 in the axial direction per unit rotation angle of the cam gear 150 (provided by the contact with the gentle slope surface F42) is smaller than the amount of displacement K2 of the cam follower 170 in the axial direction per unit rotation angle of the cam gear 150 (provided by the contact with the steep slope surface F41).

As illustrated in FIG. 7, the cam gears 150Y, 150M and 150C have configurations the same as one another, except that a length in the rotational direction of the end cam 152 of the cam gear 150Y is greater than those of the remaining cam gears 150M and 150C. Further, the cam gear 150K for the color of black has two end cams 152 each having a length in the rotational direction shorter than those of the cam gears 150Y, 150M and 150C.

The housing 10 is also provided with separation sensors 4C and 4K corresponding to the colors of black and cyan. The separation sensors 4C and 4K are phase sensors or displacement sensors for detecting a starting point of a phase or a rotational position of the cam gears 150C and 150K. The separation sensors 4C and 4K are configured to output a separation signal in response to a timing when the cam gears 150C and 150K are positioned within a predetermined phase range where the third developing roller 61C and the fourth developing roller 61K are at their separated positions. The separation sensors 4C, 4K are configured not to output the separation signal in response to a timing when the cam gears 150C and 150K are positioned outside of the predetermined phase range. In the depicted embodiment, for the sake of convenience, the separation sensors 4C, 4K are referred to as being "ON" when outputting the separation signal, and "OFF" when not outputting the separation signal. A voltage level of the ON signal may be higher or lower than that of the OFF signal.

Each separation sensor 4C, 4K includes a light emitting portion configured to emit detection light, and a light receiving portion configured to receive the detection light. Each separation sensor 4C, 4K is configured to output the ON signal to the controller 2 in a state where the counterpart detection portion 154 of the cam gear 150 is positioned between the light emitting portion and the light receiving portion to block the detection light so that the light receiving portion cannot receive detection light. On the other hand, each separation sensor 4C, 4K outputs the OFF signal to the controller 2 in a state where the counterpart detection portion 154 is displaced from a path of the detection light so that the light receiving portion can receive the detection light. Incidentally, each of the cam gears 150Y and 150M also has a part having the same shape as the shape of the counterpart detection portion 154. However, separation sensors corresponding to the parts are not provided, and therefore, these parts of the am gears 150Y and 150M are not detected.

As illustrated in FIG. 2, the cam follower 170 is slidably movably supported by the support shaft 179. The cam follower 170 is slidably movable in the axial direction by contact thereof with the end cam 152 of the corresponding cam gear 150. Specifically, the cam follower 170 is guided by the end cam 152 in accordance with the rotation of the cam gear 150 such that the cam follower 170 is movable in the axial direction between the first position illustrated in FIG. 4B and the second position illustrated in FIG. 4A. The developing roller 61 is at the separated position when the cam follower 170 is at the first position (on the first surface F1). The developing roller 61 is at the contact position when the cam follower 170 is at the second position (on the second surface F2).

The cam follower 170 includes a slide shaft portion 171, a contact portion 172, and a spring hook portion 174.

The slide shaft portion 171 is engaged with the support shaft 179. The contact portion 172 protrudes radially from the slide shaft portion 171. The contact portion 172 has one end surface in the axial direction (left end surface) that faces the end cam 152 in the axial direction. This end surface of the contact portion 172 is configured to make contact with the end cam 152 in accordance with the rotation of the cam gear 150. The spring hook portion 174 is engaged with the spring 176.

The spring 176 is a tension spring. As illustrated in FIG. 2, the spring 176 has one end portion (upper end portion) engaged with the spring hook portion 174. The spring 176 has another end portion (lower end portion) engaged with the support plate 102 at a position lower than the spring hook portion 174. Hence, the spring 176 urges the cam follower 170 toward the support plate 102, that is, the spring 176 urges the cam follower 170 in a direction from the first position toward the second position. In this way, the spring 176 normally urges the cam follower 170 against the end cam 152.

Referring to FIGS. 3A and 3B, the slide member 64 belongs to the developing cartridge 60. The slide member 64 is slidably movable in the axial direction (coincident with the extending direction of the rotation axis 61X) relative to the casing 63 by the pressure from the cam follower 170.

As illustrated in FIGS. 4A and 4B, the slide member 64 includes: a shaft 191 extending in the axial direction; a first abutment member 192 fixed to one end of the shaft 191; and a second abutment member 193 fixed to another end of the shaft 181.

The casing 63 is formed with a hole extending in the axial direction. The shaft 191 extends through the hole in the axial direction and is slidably supported by the casing 63.

The first abutment member 192 has a pressure receiving surface 192A, and a sloped surface 192B. The pressure receiving surface 192A is an end face of the first abutment member 192 in the axial direction. The sloped surface 192B is sloped with respect to the axial direction. The pressure receiving surface 192A is configured to be pressed by the cam follower 170.

The sloped surface 192B is configured to abut against the counterpart abutment portion 94 of the drawer 90 when the slide member 64 is pressed in the axial direction (rightward) by the cam follower 170, to urge the developing cartridge 60 (60Y, 60M, 60C, 60K) in a direction parallel to the sheet conveying direction D1 (frontward), and to thus move the developing cartridge 60 to the position illustrated in FIG. 4B. The sloped surface 192B is sloped in a curved fashion gradually frontward (in a direction from the photosensitive drum 50 toward the corresponding developing roller 61) toward the right (with distance from the one end (left end) of the shaft 191 in the axial direction).

The second abutment member 193 has a sloped surface 193B which is sloped in the same manner as the sloped surface 192B of the first abutment member 192. The second sloped surface 193B is configured to abut against the counterpart abutment portion 94 of the drawer 90 when the slide member 64 is pressed in the axial direction (rightward) by the cam follower 170, to urge the developing cartridge 60 (60Y, 60M, 60C, 60K) in the direction parallel to the sheet conveying direction D1 (frontward), and to thus move the developing cartridge 60 to the position as illustrated in FIG. 4B.

A spring 194 is interposed between the first abutment member 192 and the casing 63 in the axial direction to urge the slide member 64 leftward, i.e., in a direction from the other end (right end) to the one end (left end) of the shaft 191 in the axial direction. The spring 194 is a compression spring disposed over the shaft 191. In other words, the shaft 191 extends through an internal space of the spring 194 in the axial direction. The spring 194 is configured to urge the cam follower 170 toward the end cam 152 when the developing roller 61 is at the separated position (see FIG. 4B).

Next, a structure for driving and stopping the developing roller 61 will be described.

Figure 6:
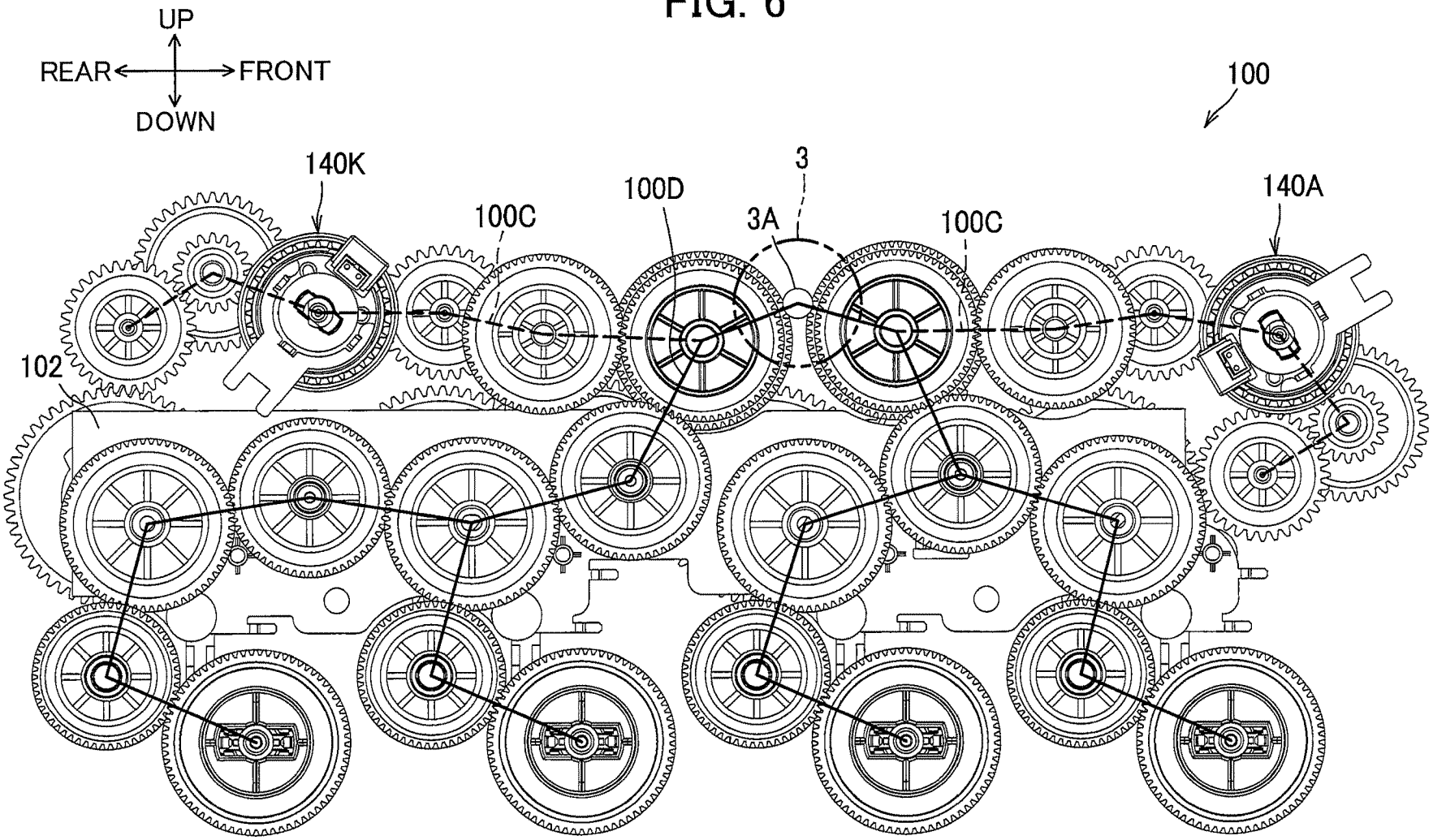
FIG. 6 is a view of a power transmission mechanism as viewed from a left side thereof in an axial direction in the image-forming apparatus according to the embodiment.

Referring to FIG. 6, the image-forming apparatus 1 includes the motor 3 and a power transmission mechanism 100. The motor 3 is configured to drive the respective developing rollers 61. The power transmission mechanism 100 is configured to transmit driving force of the motor 3 to the first developing roller 61Y, the second developing roller 61M, the third developing roller 61C, and the fourth developing roller 61, respectively. The above-described cam gears 150, which are components of the separation mechanisms, are respectively mechanically connected to the power transmission mechanism 100. The power transmission mechanism 100 is configured to shut off power transmission of the driving force of the motor 3 to the first developing roller 61Y, the second developing roller 61M, the third developing roller 61C, and the fourth developing roller 61K when each of these developing rollers 61 is at the separated position.

Figure 8:
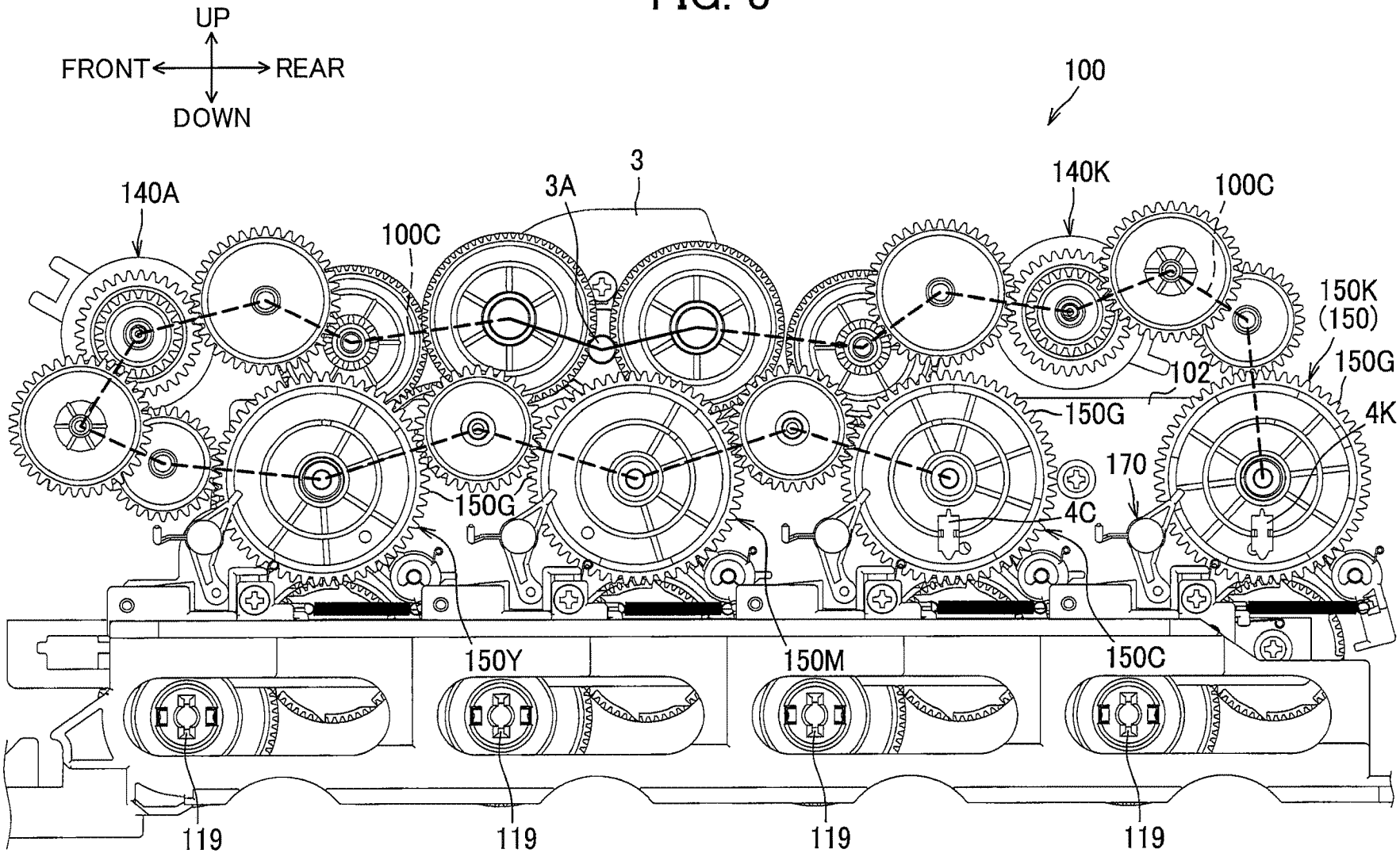
FIG. 8 is a view illustrating the power transmission mechanism as viewed from a right side thereof in the axial direction.

As best illustrated in FIG. 6, the power transmission mechanism 100 includes a power transmission gear train 100D and a transmission control gear train 100C. The power transmission gear train 100D is configured to transmit the driving force of the motor 3 to the developing rollers 61. The transmission control gear train 100C is configured to control the transmission of the driving force of the power transmission gear train 100D. The power transmission gear train 100D is mechanically connected to the transmission control gear train 100C. In FIGS. 6 and 8, meshing engagement of the gears in the power transmission gear train 100D is indicated by bold solid lines, and meshing engagement of the gears in the transmission control gear train 100C is indicated by bold broken lines. Each gear constituting the power transmission gear train 100D is supported by the support plate 102 or a frame not illustrated, and is rotatable about a rotation axis extending in the axial direction of the photosensitive drum 50.

As illustrated in FIGS. 7 and 8, the transmission control gear train 100C mechanically connects an output shaft 3A of the motor 3 to each cam gear 150 through meshing engagement of a plurality of gears. The transmission control gear train 100C includes a YMC clutch 140A for yellow, magenta and cyan grouping, and a K clutch 140K for black grouping. Each gear constituting the transmission control gear train 100C is supported by the support plate 102 or the frame not illustrated, and is rotatable about a rotation axis extending in the axial direction of the photosensitive drum 50.

The YMC clutch 140A is configured to perform change-over between transmission and cut-off of the driving force to the cam gears 150 for the yellow, magenta and cyan grouping in the transmission control gear train 100C. That is, the YMC clutch 140A is configured to switch from a rotation state to a non-rotation state and vice versa of the cam gears 150Y, 150M and 150C.

An electromagnetic clutch is available as the YMC clutch 140A. The cam gears 150Y, 150M and 150C are configured to start rotating upon power supply (turning ON) of the YMC clutch 140A, and to stop rotating upon halt of the power supply (turning OFF) of the YMC clutch 140A.

The K clutch 140K has a structure the same as that of the YMC clutch 140A. The K clutch 140K is configured to perform change-over between transmission and cut-off of the driving force to the cam gear 150 for the black grouping in the transmission control gear train 100C. That is, the K clutch 140K is configured to switch from a rotation state to a non-rotation state and vice versa of the cam gear 150K. The cam gear 150K is configured to start rotating upon power supply (turning ON) of the K clutch 140K, and to stop rotating upon halt of the power supply (turning OFF) of the K clutch 140K.

The controller 2 is configured to control the YMC clutch 140A and the K clutch 140K to control rotation/non-rotation of the cam gears 150. Specifically, when starting a printing operation while each developing roller 61 is at the separated position, the controller 2 permits the YMC clutch 140A and the K clutch 140K to turn ON for a predetermined time period at a prescribed timing and then to turn OFF. Hence, each of the developing rollers 61 is moved to the contact position.

On the other hand, when terminating the printing operation, the controller 2 permits the YMC clutch 140A and the K clutch 140K to turn ON, and then permits the YMC clutch 140A to turn OFF in response to detection of the counterpart detecting portion 154 by the separation sensor 4C, and to permits the K clutch 140K to turn OFF in response to detection of the counterpart detecting portion 154 by the separation sensor 4K. In this way, each of the developing rollers 61 is moved to the separated position.

Next, the sliding movement of the cam follower 170 in response to the rotation of the cam gear 150 will be described with reference to FIGS. 12A through 12E.

Figure 12A:
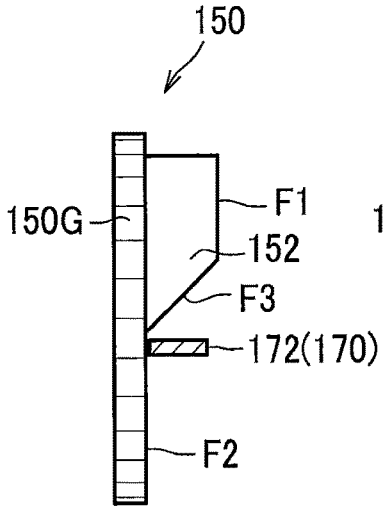
FIGS. 12A through 12E are views for description of sliding movement of the cam follower in response to rotation of the cam gear, and FIG. 12A particularly illustrates a state where the cam follower is in contact with a second surface of the end cam of the cam gear.

As illustrated in FIG. 12A, when the developing roller 61 is at the contact position, the cam follower 170 is at the second position where the contact portion 172 of the cam follower 170 is in contact with the second surface F2 of the cam gear 150.

Figure 12B:
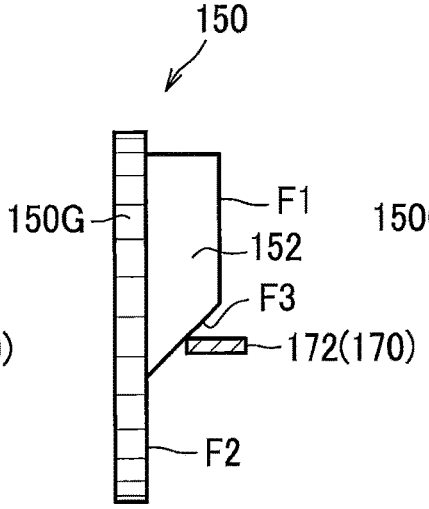

As the cam gear 150 starts rotating from the state illustrated in FIG. 4A, the contact portion 172 is brought into contact with the first sloped surface F3, and is guided by the first sloped surface F3 to slidingly moved in the axial direction, as illustrated in FIG. 12B.

Figure 12C:
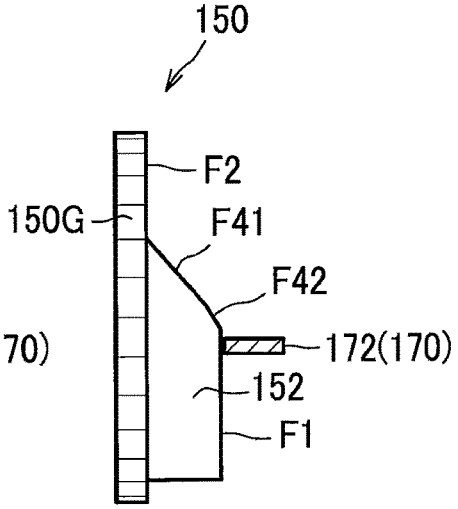

In accordance with further rotation of the cam gear 150 from the state illustrated in FIG. 12B, the contact portion 172 is brought into contact with the first surface F1 as illustrated in FIG. 12C, and hence, the cam follower 170 is positioned at the first position. Accordingly, the developing roller 61 is positioned at the separated position.

Figure 12D:
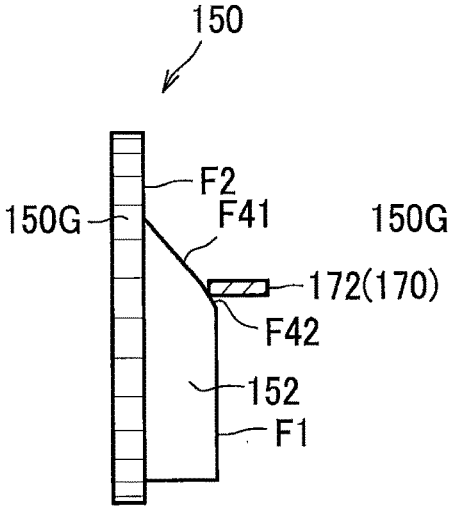

In accordance with further rotation of the cam gear 150 from the state illustrated in FIG. 12C, the contact portion 172 is brought into contact with the gentle slope surface F42 of the second sloped surface F4, as illustrated in FIG. 12D. At this time, the cam gear 150 is pressed by the cam follower 170, since the cam follower 170 is pressed against the end cam 152 by the urging force of the spring 176. Further, repulsive force of the compressed spring 194 when the cam follower 170 is at the first position (FIG. 4B) is also applied to the cam follower 170 in the axial direction to press the cam follower 170 outward in the axial direction against the end cam 152. Hence, the cam gear 150 is reversely rotated by an amount of backlash of the gear portion 150G, so that each gear connected to the cam gear 150 in the transmission control gear train 100C is reversely rotated by the amount of backlash. At this time, collision sound may be generated due to impact of mutually engaging gear teeth.

Figure 12E:
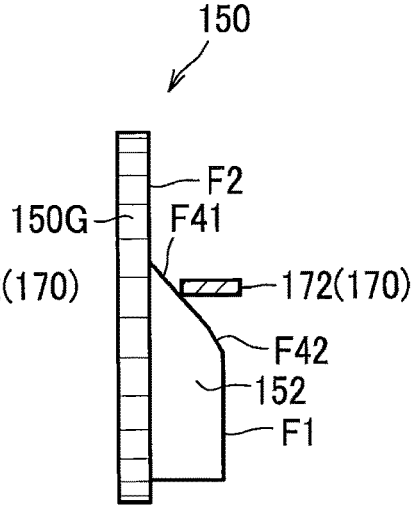

In accordance with further rotation of the cam gear 150 from the state illustrated in FIG. 12D, the contact portion 172 is brought into contact with the steep slope surface F41 of the second sloped surface F4, as illustrated in FIG. 12E. The contact portion 172 is guided by the steep slope surface F41 to slidingly move onto the second surface F2. Thus, the contact portion 172 is again brought into contact with the second surface F2, as illustrated in FIG. 12A.

<Technical Advantages of the Embodiment>

According to the above-described embodiment, in order to move the developing roller 61 from the separated position to the contact position, the cam follower 170 is guided by the second sloped surface F4 to move from the first surface F1 to the second surface F2. At this time, the cam follower 170 is initially guided by the gentle slope surface F42 of the second sloped surface F4. That is, the cam follower 170 is gently and slowly moved onto the second surface F2 from the first surface F1 by the guide of the gentle slope surface F42 whose slope is gentler than the slope of the steep slope surface F41 (the angle θ2<the angle θ1). The configuration of the embodiment can suppress generation of collision sound during the movement of the developing roller 61 from the separated position to the contact position.

Referring to FIG. 11, the displacement amount K1 of the cam follower 170 in the axial direction per unit rotation angle of the cam gear 150 within the predetermined angular region (the central angle A1) is smaller than the displacement amount K2 of the cam follower 170 in the axial direction per unit rotation angle of the cam gear 150 outside of the predetermined angular region (the central angle A2) on the second sloped surface F4. As a result, collision sound generated by collision of gear teeth due to reverse rotation of the cam gear 150 (while the cam follower 170 is placed on the gentle slope surface F42) can be reduced.

Further, since the cam gear 150 is made from polyacetal resin, collision sound of the cam gear 150 can be reduced.

Further, the cam follower 170 can be promptly moved from the first surface F1 to the second surface F2 in a shorter period of time than otherwise, since the steep slope surface F41 has a region greater than the region of the gentle slope surface F42 in the rotational direction of the cam gear 150 on the second sloped surface F4.

<Modifications>

While the description has been made in detail with reference to the embodiment, it would be apparent to those skilled in the art that many modifications and variations may be made thereto.

Figure 13A:
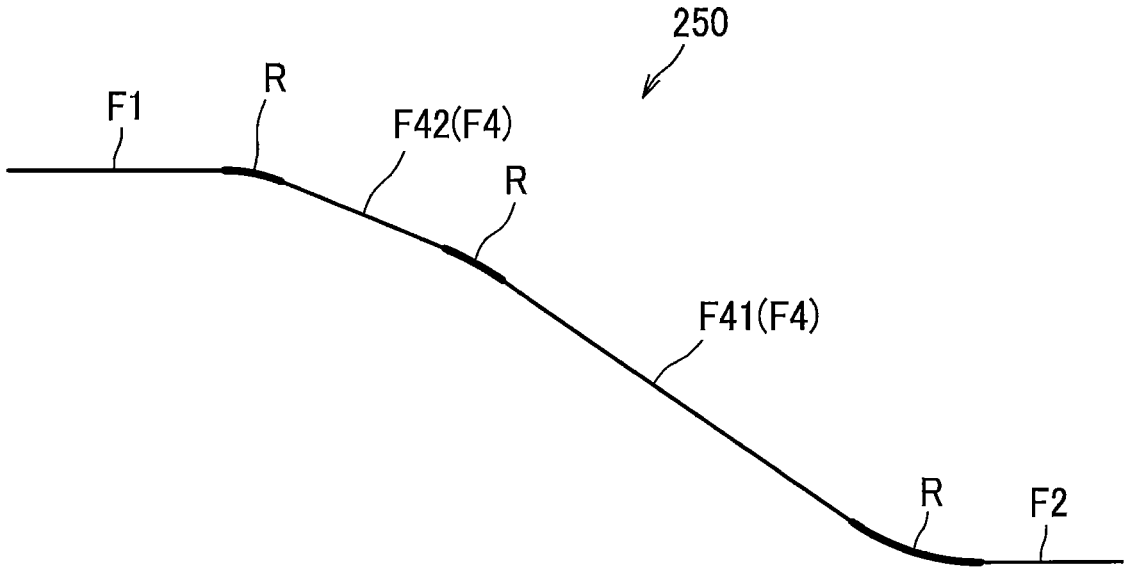
FIG. 13A is a view illustrating cam surfaces of an end cam of a cam gear according to a first modification to the embodiment.

For example, in the end cam 152 of the above-described embodiment, angled joint portions are provided between the first surface F1 and the gentle slope surface F42, between the gentle slope surface F42 and the steep slope surface F41, and between the steep slope surface F41 and the second surface F2. However, as illustrated in FIG. 13A, a cam gear 250 may have rounded joint portions R, instead of the angled joint portions, between the first surface F1 and the gentle slope surface F42, between the gentle slope surface F42 and the steep slope surface F41, and between the steep slope surface F41 and the second surface F2.

Figure 13B:
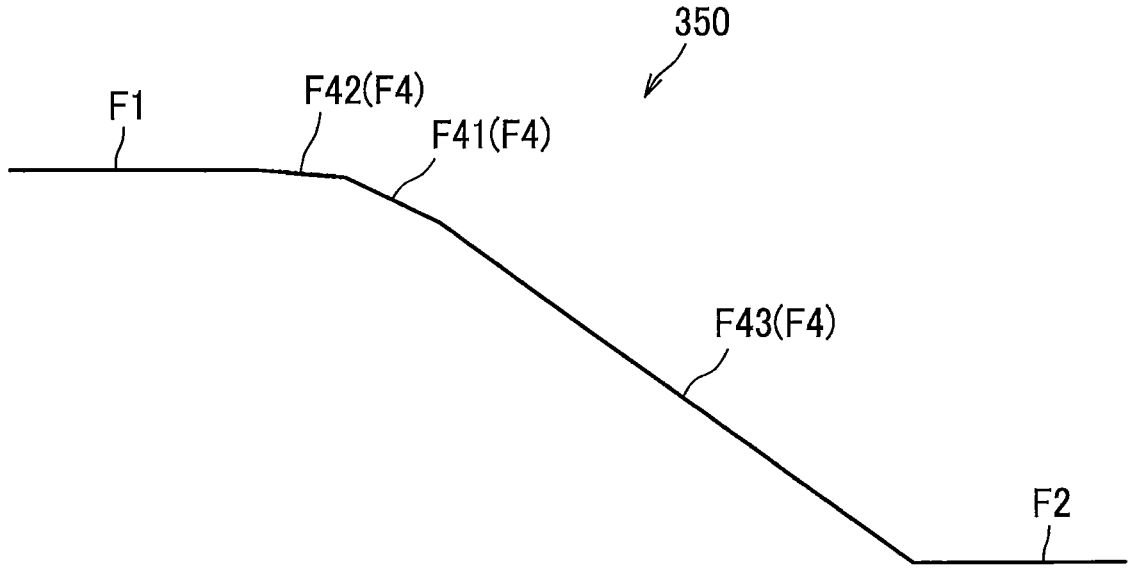
FIG. 13B is a view illustrating cam surfaces of an end cam of a am gear according to a second modification to the embodiment.

Further, in the above-described embodiment, the second sloped surface F4 of the end cam 152 is configured of the steep slope surface F41 and the gentle slope surface F42 only. Alternatively, as illustrated in FIG. 13B, the second sloped surface F4 may further include an additional sloped surface F43 between the steep slope surface F41 and the second surface F2. The additional sloped surface F43 may be steeper than the steep slope surface F41.

Further, in the above-described embodiment, the contact portion 172 of the cam follower 170 is in contact with the second surface F2 of the cam gear 150, when the cam follower 170 is at the second position. However, the contact portion 172 of the cam follower 170 need not contact the second surface F2 of the cam gear 150, provided that the second surface F2 allows the cam follower 170 to be positioned at the second position. For example, the contact portion 172 of the cam follower 170 may face the second surface F2 with a gap therebetween when the cam follower 170 is at the second position.

Further, in the above-described embodiment, the cam gear 150 is made from polyacetal resin. However, a cam gear of the disclosure may be made from a resin other than polyacetal resin, or may be made from a material other than resin.

Further, in the above-described embodiment, the spring 176 is a tension spring. However, a compression spring and a torsion spring are available as long as these springs can urge the cam follower 170 toward the end cam 152.

Further, in the above-described embodiment, each of the second openings 91A formed in the left side frame 91L of the drawer 90 is in the form of recess or notch whose upper end is open. However, each second opening may be a through-hole extending throughout a thickness of the left side frame 91L of the drawer 90.

Further, according to the above-described embodiment, the image-forming apparatus 1 is a color printer using toners of four colors. However, an image-forming apparatus of the present disclosure may employ toners of three colors or five colors for forming a color image. As a further modification, a monochromatic printer is also available as the image-forming apparatus of the disclosure.

Further, a multifunction device and a copying machine are also available as the image-forming apparatus.

[Remarks]

The image-forming apparatus 1 is an example of an image-forming apparatus. The motor 3 is an example of a motor. The photosensitive drum 50 is an example of a photosensitive drum. The developing roller 61 is an example of a developing roller. The end cam 152 is an example of an end cam. The cam follower 170 is an example of a cam follower. The cam gear 150 is an example of a cam gear. The rotation axis 150X is an example of a rotation axis of the cam gear. The disc portion 151 is an example of a body portion. The gear portion 150G is an example of a gear portion. The spring 176 is an example of a spring. The first surface F1 is an example of a first surface of the end cam. The second surface F2 is an example of a second surface of the end cam. The first sloped surface F3 is an example of a first sloped surface of the end cam. The second sloped surface F4 is an example of a second sloped surface of the end cam. The steep slope surface F41 is an example of a steep slope surface of the second sloped surface of the end cam. The gentle slope surface F42 is an example of a gently slope surface of the second sloped surface of the end cam. The angle θ1 is an example of a first angle. The angle θ2 is an example of a second angle. The central angle A1 is an example of a first central angle. The central angle A2 is an example of a second central angle.

What is claimed is:

1. An image-forming apparatus comprising:

a motor;

a photosensitive drum;

a developing roller movable between a contact position where the developing roller is in contact with the photosensitive drum and a separated position where the developing roller is separated from the photosensitive drum; and a separation mechanism configured to move the developing roller between the contact position and the separated position upon receipt of a driving force from the motor, the separation mechanism comprising:

an end cam rotatable in a rotational direction, the end cam comprising:

a first surface;

a second surface;

a first sloped surface connecting the second surface to the first surface in the rotational direction; and a second sloped surface connecting the first surface to the second surface in the rotational direction, the second sloped surface comprising:

a steep slope surface connected to the second surface in the rotational direction and sloping relative to the first surface by a first angle; and a gentle slope surface connecting the first surface to the steep slope surface in the rotational direction, the gentle slope surface sloping relative to the first surface by a second angle smaller than the first angle; and a cam follower movable between a first position at which the developing roller is at the separated position and a second position at which the developing roller is at the contact position in accordance with a rotation of the end cam, the first surface being configured to support the cam follower at the first position, the second surface being configured to support the cam follower at the second position, the first sloped surface being configured to guide the cam follower from the second surface to the first surface, the second sloped surface being configured to guide the cam follower from the first surface to the second surface.

2. The image-forming apparatus according to claim 1, wherein the separation mechanism further comprises:

a cam gear rotatable in the rotational direction about a rotation axis extending in an axial direction, the cam gear comprising:

a body portion having a disc shape and defining a rotation center of the cam gear through which the rotation axis extends;

a gear portion provided along a circumference of the body portion and configured to receive the driving force; and the end cam, the end cam being provided on the body portion to protrude therefrom in the axial direction and extending in the rotational direction; and a spring urging the cam follower to be in pressure contact with the end cam, wherein the cam follower is configured to contact the end cam and slidably movable in the axial direction by contact with the end cam to move between the first position and the second position.

3. The image-forming apparatus according to claim 2, wherein the gentle slope surface extends in the rotational direction to form a first central angle about the rotation center of the cam gear, and the steep slope surface extends in the rotational direction to form a second central angle about the rotation center of the cam gear, the first central angle of the gentle slope surface being smaller than the second central angle of the steep slope surface.

4. The image-forming apparatus according to claim 3, wherein the first central angle of the gentle slope surface is not more than one-fourth of the second central angle of the steep slope surface.

5. The image-forming apparatus according to claim 2, wherein the rotation axis of the cam gear extends parallel to a rotation axis of the developing roller.

6. The image-forming apparatus according to claim 2, wherein the cam gear is made from polyacetal resin.

7. The image-forming apparatus according to claim 1, wherein the first angle defined between gentle slope surface and the first surface ranges from 15 to 25 degrees, and wherein the second angle defined between the steep slope surface and the first surface ranges from 30 to 40 degrees.

8. An image-forming apparatus comprising:

a motor;

a photosensitive drum;

a developing roller movable between a contact position where the developing roller is in contact with the photosensitive drum and a separated position where the developing roller is separated from the photosensitive drum; and a separation mechanism configured to move the developing roller between the contact position and the separated position upon receipt of a driving force from the motor, the separation mechanism comprising:

an end cam rotatable in a rotational direction about a rotation axis extending in an axial direction, the end cam comprising:

a first surface;

a second surface;

a first sloped surface connecting the second surface to the first surface in the rotational direction; and a second sloped surface connecting the first surface to the second surface in the rotational direction, the second sloped surface being connected to the first surface at a joint portion in the rotational direction, the second sloped surface having: a predetermined angular region starting from the joint portion in the rotational direction; and an outside angular region outside of the predetermined angular region in the rotational direction; and a cam follower movable in the axial direction between a first position at which the developing roller is at the separated position and a second position at which the developing roller is at the contact position in accordance with a rotation of the end cam, the first surface being configured to support the cam follower at the first position, the second surface being configured to support the cam follower at the second position, the first sloped surface being configured to guide the cam follower from the second surface to the first surface, the second sloped surface being configured to guide the cam follower from the first surface to the second surface, an amount of displacement of the cam follower in the axial direction per unit rotation angle of the end cam while the cam follower is in contact with the predetermined angular region being smaller than an amount of displacement of the cam follower in the axial direction per unit rotation angle of the end cam while the cam follower is in contact with the outside angular region.

9. The image-forming apparatus according to claim 8, wherein the separation mechanism further comprises:

a cam gear rotatable in the rotational direction about the rotation axis extending in the axial direction, the cam gear comprising:

a body portion having a disc shape and defining a rotation center of the cam gear through which the rotation axis extends;

a gear portion provided along a circumference of the body portion and configured to receive the driving force; and the end cam, the end cam being provided at the body portion and extending in the rotational direction of the cam gear; and a spring urging the cam follower to be in pressure contact with the end cam, wherein the cam follower is slidably movable in the axial direction by contact with the end cam to move between the first position and the second position.

10. The image-forming apparatus according to claim 9, wherein the predetermined angular region of the second sloped surface extends in the rotational direction to form a first central angle about the rotation center of the cam gear, and the outside angular region of the second sloped surface extends in the rotational direction to form a second central angle about the rotation center of the cam gear, the first central angle of the predetermined angular region being smaller than the second central angle of the outside angular region.

11. The image-forming apparatus according to claim 10, wherein the first central angle of the predetermined angular region is not more than one-fourth of the second central angle of the outside angular region.

12. The image-forming apparatus according to claim 9, wherein the rotation axis of the cam gear extends parallel to a rotation axis of the developing roller.

13. The image-forming apparatus according to claim 9, wherein the cam gear is made from polyacetal resin.

14. The image-forming apparatus according to claim 8, wherein the predetermined angular region is sloped relative to the first surface by an angle ranging from 15 to 25 degrees, and wherein the outside angular region is sloped relative to the first surface by an angle ranging from 30 to 40 degrees.

* * * * *